United States Patent [19]

Belinsky

[11] 4,251,098

[45] Feb. 17, 1981

[54] UNDER-THE-ROOF LOADER

[76] Inventor: Sidney I. Belinsky, 40 Waterside Plz., Apt. 29M, New York, N.Y. 10010

[21] Appl. No.: 958,809

[22] Filed: Dec. 4, 1978

Related U.S. Application Data

[63] Continuation-in-part of Ser. No. 786,542, Apr. 11, 1977, abandoned.

[51] Int. Cl.[3] ..... B66C 1/00

[52] U.S. Cl. ..... 294/67 AA

[58] Field of Search ..... 294/67 AA, 67 A, 67 C, 294/67 R, 81 R, 78 A, 861 S; 212/48, 49; 280/758; 74/394

[56] References Cited

U.S. PATENT DOCUMENTS 3,762,755 10/1973 Saether ..... 294/67 AA

*Primary Examiner*—James B. Marbert

[57] ABSTRACT

An Under-the-roof loader is an elongated boom which is connected to the crane lift line through its fulcrum axis and it is balanced in respect to this axis. The purely mechanical automatical balancing system, which actuates by boom inclination during initial period of lifting the load, moves the counterweight in opposite from the loaddirection until it balances the lifting load. At this moment inclination of the boom stops and the crane starts to lift the load simultaneously with all parts of the boom including counterweight. The railguides for counterweight are so curved that the gravity force of counterweight is at all time normal to the curve while the counterweight moves along the curved part of the boom proportionally to the angle of boom inclination. The mechanism transfering the boom inclination in the reciprocating motion of the counterweight consists of two levers.

4 Claims, 4 Drawing Figures

UNDER-THE-ROOF LOADER

CROSS-REFERENCE TO RELATED APPLICATION

This application is a Continuation-in-Part of my copending application Ser. No. 786,542 filed Apr. 11, 1977 entitled HOISTING DEVICE FOR A CRANE now abandoned.

BACKGROUND AND SUMMARY OF THE INVENTION

The present invention generally relates to the hoisting apparatuses and more particularly refers to an elongated boom automatically balanced by counterweight and suspended on the crane lift line for the use in locating loads under various types of roofs, or for increasing the crane-serving areas.

From prior art (U.S. Pat. No. 3,675,961 to Wheeler issued July 11, 1972; U.S. Pat. No. 3,762,755 to Saether issued Oct. 2, 1973), it is known that only electro-automatical systems were used for the automatical balancing elongated boom with the load. This system utilizes several electrical switches, electrical motor and power supply arrangements which are all subjects to random failure and therefore could not meet existing high standards of safety for cargolifting devices.

The first patented hoisting device which may satisfy the standards of safety, utilizes purely mechanical automatical system for balancing elongated boom with counterweight, is granted in my name (U.S. Pat. No. 4,017,109 issued Apr. 12, 1977). The reason why this device will satisfy the high standards of safety is that it consists of only mechanical elements and the high reliability of each of them is proved by several types of existing hoisting devices utilizing similar elements.

Objectives of this invention are improvements of patented HOISTING DEVICE FOR A CRANE, U.S. Pat. No. 4,017,109.

The main invention consists of an elongated boom with a moveable counterweight which automatically balances the boom when it picks up the load, relatively to the fulcrum axis to which crane lift line is attached.

In the unloaded condition the center of gravity of all system incuding the counterweight is located under the fulcrum axis and on the vertical continuation of the crane lift line. At the moment when a crane starts to lift the load first moves up the fulcrum axis, to which the crane lift line is connected, thus inclining the boom around the fulcrum axis because the load at this moment is not balanced. During this inclination the angle between the crane lift line, which under gravity forces is permanently in vertical position, and the boom is changing. Due to the purely mechanical system this angular alteration transfers to horizontal movement of counterweight off its central location along the guiding trucks on the boom in direction opposite to the load location. At the moment when counterweight moves from its central position on such a distance that it balances the load on opposite side of the boom, the inclination of the boom stops and all parts of the boom including the load start to lift up simultaneously with the crane lift line.

Improvements of this invention are as follows:

The first improvement relates to the guides for the counterweight. Improved railguides for the counterweight are so curved that the gravity force of the counterweight is all time normal to the curve while the counterweight moves along the curved part of the boom proportionally to the angle of boom inclination. This feature allows to increase angle of the boom inclination, it reduces considerably acting forces and as a consequence reduces the size of the mechanism for moving counterweight comparatively to straight quides which are on the patented device.

The second improvement which is used in a second embodiment relates to the mechanism transferring the boom inclination in the reciprocating motion of the counterweight. Proposed is a system of levers which consists of an intermediate lever and a driving lever. The driving lever is connected through an articulated joint on its upper part to a bearer which is an integrated part of a pivotal part of the boom. Through the intermediate lever the driving lever receives angular movement proportionally to the angular inclination of the boom. Proportional angular movement of the lower end of the driving lever, through the sliding frog and elongated opening in the middle of the counterweight carriage, transfers to a proportional movement of the counterweight along the curved guides.

This improvement simplifies considerably the mentioned mechanism comparative to a patented device, eliminating gear and chain transmission by substituting them with simple levers. The reliability of the levers is higher, manufacturing cost is less and they practically do not require any maintenance.

A. FIRST EMBODIMENT

Figure 1:
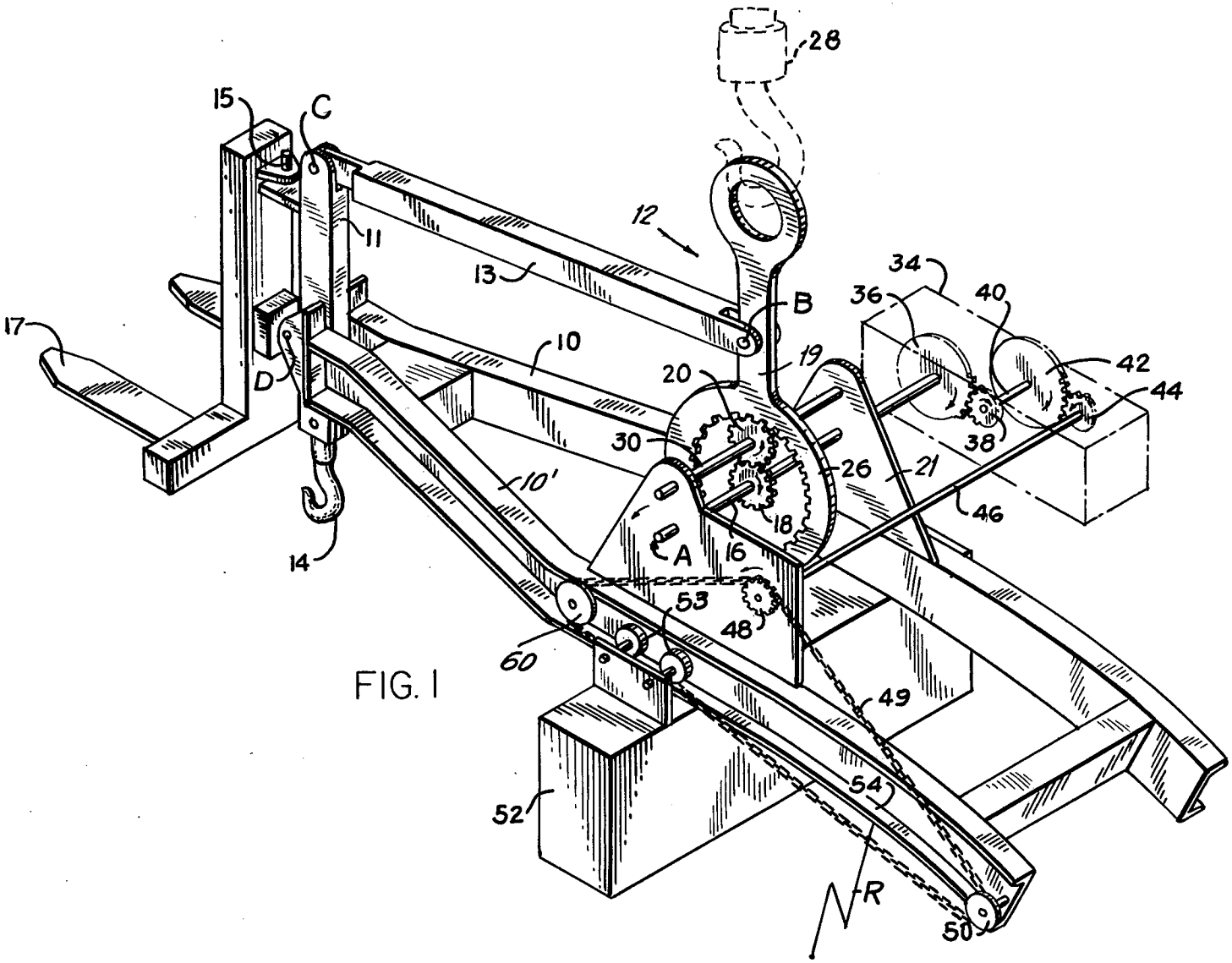
FIG. 1 is a schematic diagram of the hoisting apparatus described in First embodiment.

Referring to the first embodiment of the invention illustrated in FIG. 1 the hoisting apparatus (Under-the-Roof Loader) generally designated by numeral (12) is shown operatively connected and supported by a crane lift line attached to a hook (28). The hoisting device consists of the boom (10) and (10'0) with an A, B, C, D parallelogram mechanism including vertical beam (11) to which is connected a hook (14) to enable lifting of loads, horizontal beam (13) and vertical member (19). The dual arms of the boom (10) and (10') are pivoted on main axis A around main shaft (16). By means of pin (15), the fork lift (17) can be connected to vertical beam (11). The main vertical member (19) in the parallelogram A,B,C,D is a link between planet gear (26) and the eye for a crane hook (28). Mounting on the shaft (16) is a main gear (18) which is in engagement with satellite gear (20). The gear (20) is in driver engagement with a planet gear (26). The gearing system and the boom are supported by a crane hook (28).

The satellite gear (20) is journalled on a swing shaft (30) connected to the boom (10) through vertical shaft support member (21). As the boom (10) is tilted under the weight of the load, the sun gear (20) is caused to rotate on the planet gear (26) thus driving main gear (18) mounted on the shaft (16), which in turn is in driving connection with multiplicator (34). Multiplicator (34) has a gear (36) mounted on the shaft (16) in driving connection with a reduction gear (38) mounted on the shaft (40). Also mounted on the later is gear (42) which engages gear (44). The later is mounted on one of the ends of the shaft (46), on its other end is mounted sprocket (48) engaging chain (49).

Chain (49) through sprocket (50) and (60) is connected to the counterweight (52), which by means of rollers (53) slides on railguides (54). While not illustrated in the drawings counterweight (52) is so constructed as to be either supported by the inside arm (10) of the dual boom or internally balanced so as not to sag in any manner.

Figure 2:
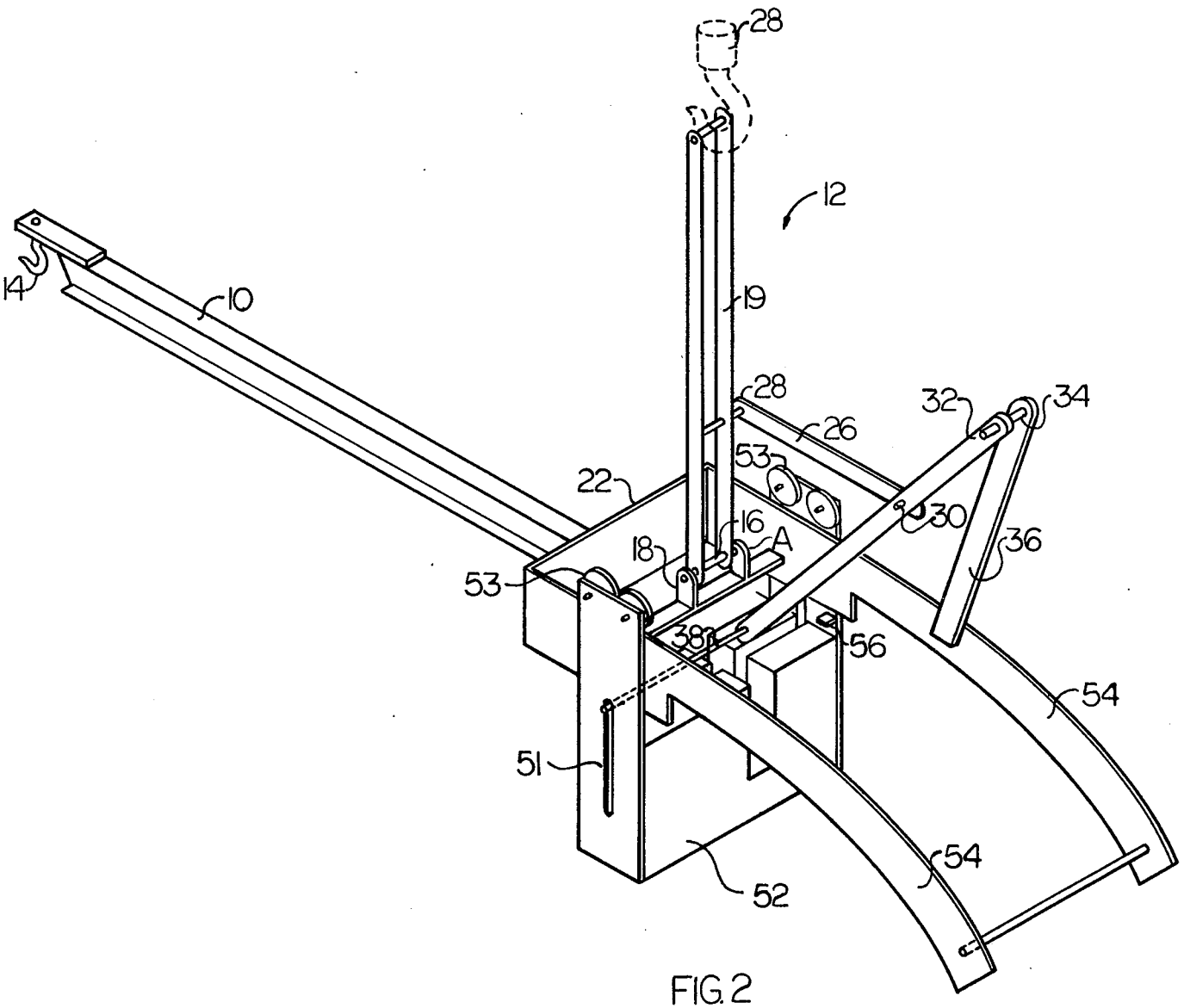
FIG. 2' is a schematic diagram of the hoisting apparatus described in second embodiment.

An apparatus, utilizing levers instead of gears and chains for mechanism transfering the boom inclination into the horizontal movement of the counterweight, is provided for the second embodiment of this invention and is now described with reference to FIG. 2' through FIG. 4'.

The parts of the second embodiment analogous to the parts previously described in the first embodiment are indicated by primed reference. Refering to the second embodiment of invention illustrated in FIG. 2 the hoisting apparatus (Under-the-Roof Loader) generally designated by numeral (12') is shown operatively connected and supported by a crane lift line attached to a hook (28'). The under-the-roof loader consists of boom's load lifting part (10), which is equipped with a hook (14'). The vertical element (19') which is a link between crane lifting line with hook (28') and fulcrum axis (16')"A". The fulcrum axis (16') through bearings (18) is connected to boom's curve part (22), which is fixed with boom's load lifting part (10). The mechanism transfering boom inclination in horizontal movement of the counterweight consists of intermediate lever (26) which through articulated joints (28) and (30) connects vertical element (19) with driving lever (32). Through articulated joint (34) the upper part of driving lever (32) is connected to a bearer (36), which is fixed to the boom's curved part (22). The lower part of the driving lever (32) through the sliding frog (38) is connected with vertical alongated guides (51) of the counterweight (52). The counterweight (52) is equipped with four wheels (53') which roll on railguides (54') of the boom's pivotal part. The counterweight (52') is equipped with stops (56) which support the boom's pivotal part (22) when the under-the-roof loader is staying on the ground, utilizing the counterweight (52') as a base.

Figure 3:
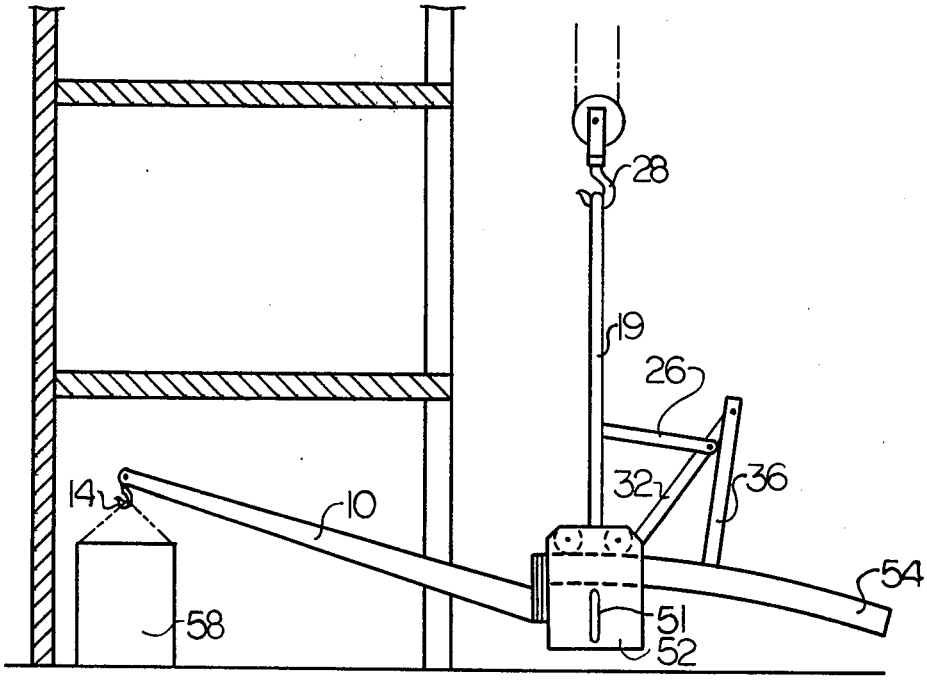
FIG. 3' is an elevation view of the hoisting apparatus of the present invention in a position before lifting the load.

FIG. 3' shows the Under-the-Roof Loader (URL) at the moment when it hangs on the crane hook (28') and ready to start lifting the load (58) located under th roof. In this position the counterweight is on one line with crane's lift line and URL is fully balanced.

Figure 4:
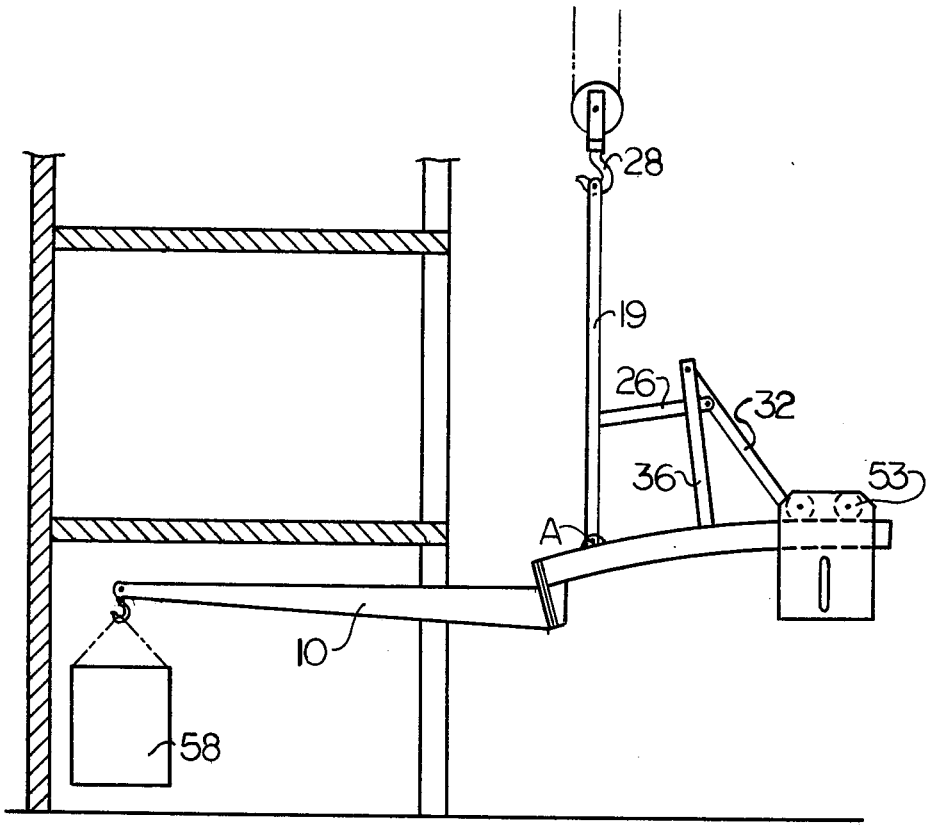
FIG. 4' is an elevation view of the hoisting apparatus in a position after lifting a maximum load.

FIG. 4' shows the Under-the-Roof Loader (URL) at the moment when it, with the help of the crane, lifts ultimate load. In this position the boom is pivoted around fulcrum axis "A" and the counterweight (52) is shifted by driving lever (32) to limited right position on the railguides (54'), balancing the lifted load (58).

Obviously, many modifications and variations of the present invention are possible in the light of the above teachings, and it is therefore understood that within the scope of the disclosed inventive concept, the invention may be practiced otherwise than specifically described.

What is claimed is:

1. The Under-the-Roof Loader (URL) for hoisting load by lifting line through suspended to it in one point elongated balanced boom with purely mechanical automatically balancing system, transfering boom inclination into reciprocating movement of moveable counterweight along the guides on said elongated boom, comprising: vertical element with articulated joint between its ends, upper end of said vertical element is adapted to receive said lifting line and lower end of said vertical element is connected through articulated joint with fulcrum axis on said elongated boom; intermediate lever, connecting said vertical element through its articulated joint, located between upper and lower ends, and pins, located on the ends of said intermediate lever, to driving lever through its articulated joint, located between upper and lower ends; said driving lever, which is hinged through its upper end to a fixed point on said elongated boom and through its lower end said driving lever is engaged with said moveable counterweight by means of sliding frog.

2. The Under-the-Roof Loader as in claim 1, said elongated boom comprising guides for said moveable counterweight, said guides are so curved that the gravity force of said counterweight is at all times normal to the curve while the said counterweight moves along the curved part of said boom proportionally to the boom inclination.

3. The Under-the-Roof Loader as in claim 1, said moveable counterweight comprising vertical elongated guides in its middle through which said moveable counterweight is engaged with said sliding frog on the lower end of said driving lever.

4. The Under-the-Roof Loader as in claim 1, said fixed point on said elongated boom is located on the bearer perpendicular to the middle of said curved part of said elongated boom.

* * * * *